US007350995B1

(12) United States Patent
Rhodes

(10) Patent No.: US 7,350,995 B1
(45) Date of Patent: Apr. 1, 2008

(54) MARKER ERASER SYSTEM

(76) Inventor: Julia M. Rhodes, P.O. Box 4796, Sonora, CA (US) 95370

( * ) Notice: Subject to any disclaimer, the term of this patent is extended or adjusted under 35 U.S.C. 154(b) by 0 days.

(21) Appl. No.: 11/613,057

(22) Filed: Dec. 19, 2006

(51) Int. Cl.
*B43K 25/00* (2006.01)
*B43K 29/00* (2006.01)
*B43L 19/00* (2006.01)

(52) U.S. Cl. ..... 401/52; 401/202; 15/424; 15/428

(58) Field of Classification Search ..... 401/52, 401/195, 202; 15/424–428, 431, 432
See application file for complete search history.

(56) References Cited

U.S. PATENT DOCUMENTS 5,432,973 A * 7/1995 Wagner et al. ..... 15/210.1
5,855,442 A 1/1999 Keller
5,871,294 A * 2/1999 Turner ..... 401/52
6,932,531 B2 * 8/2005 Marschand et al. ..... 401/202

* cited by examiner

*Primary Examiner*—David J. Walczak
(74) *Attorney, Agent, or Firm*—William Mullen; M. Bruce Harper

(57) ABSTRACT

A marker eraser system for efficiently combining an eraser with a dry erase marker. The marker eraser system includes a body having a tubular structure and a central aperture extending through the tubular structure. The central aperture extends through an inner end to an outer end of the body. An eraser member is attached to the outer end of the eraser unit to erase a removable ink from a dry erase marker. An outer end of the central aperture frictionally receives an outer portion of a first end of a cap of the dry erase marker to allow a user to removably attach the marker eraser system to the cap of the dry erase marker.

22 Claims, 7 Drawing Sheets

MARKER ERASER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to markers and more specifically it relates to a marker eraser system for efficiently integrating an eraser with a dry erase marker.

2. Description of the Related Art

Any discussion of the prior art throughout the specification should in no way be considered as an admission that such prior art is widely known or forms part of common general knowledge in the field.

Markers have been in use for years. Typically, markers are comprised of various configurations, such as but not limited to dry erase markers, permanent markers and highlighters. Dry erase markers are generally used when teaching in classrooms or anytime that an erasable marker is needed. To erase markings from dry erase markers, the dry erase markers generally must be accompanied with a separate eraser.

Many teachers use dry erase markers almost exclusively because of the convenience of teaching with dry erase boards. When using dry erase markers, it can be a nuisance to carry around an eraser separate from the marker. Erasers generally become lost or wear out over time. When an eraser is lost, the user of the dry erase markers must erase the dry erase board with their hand, which can be very messy and inefficient.

While these devices may be suitable for the particular purpose to which they address, they are not as suitable for efficiently combining an eraser with a dry erase marker. It can be very inconvenient to carry around a marker and a separate eraser while utilizing a dry erase marker and board system.

In these respects, the marker eraser system according to the present invention substantially departs from the conventional concepts and designs of the prior art, and in so doing provides an apparatus primarily developed for the purpose of efficiently combining an eraser with a dry erase marker.

BRIEF SUMMARY OF THE INVENTION

In view of the foregoing disadvantages inherent in the known types of markers now present in the prior art, the present invention provides a new marker eraser system construction wherein the same can be utilized for efficiently combining an eraser with a dry erase marker.

The general purpose of the present invention, which will be described subsequently in greater detail, is to provide a new marker eraser system that has many of the advantages of the markers mentioned heretofore and many novel features that result in a new marker eraser system which is not anticipated, rendered obvious, suggested, or even implied by any of the prior art markers, either alone or in any combination thereof.

To attain this, the present invention generally comprises a body having a tubular structure and a central aperture extending through the tubular structure. The central aperture extends through an inner end to an outer end of the body. An eraser member is attached to the outer end of the eraser unit to erase a removable ink from a dry erase marker. An outer end of the central aperture frictionally receives an outer portion of a first end of a cap of the dry erase marker to allow a user to removably attach the marker eraser system to the cap of the dry erase marker.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a marker eraser system that will overcome the shortcomings of the prior art devices.

A secondary object is to provide a marker eraser system for efficiently combining an eraser with a dry erase marker.

Another object is to provide a marker eraser system that includes an easily attachable eraser.

An additional object is to provide a marker eraser system that includes an eraser that is interchangeable with various dry erase markers.

A further object is to provide a marker eraser system that includes an ergonomic handle for easy writing.

Another object is to provide a marker eraser system that is comprised of a configuration to efficiently store an eraser.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
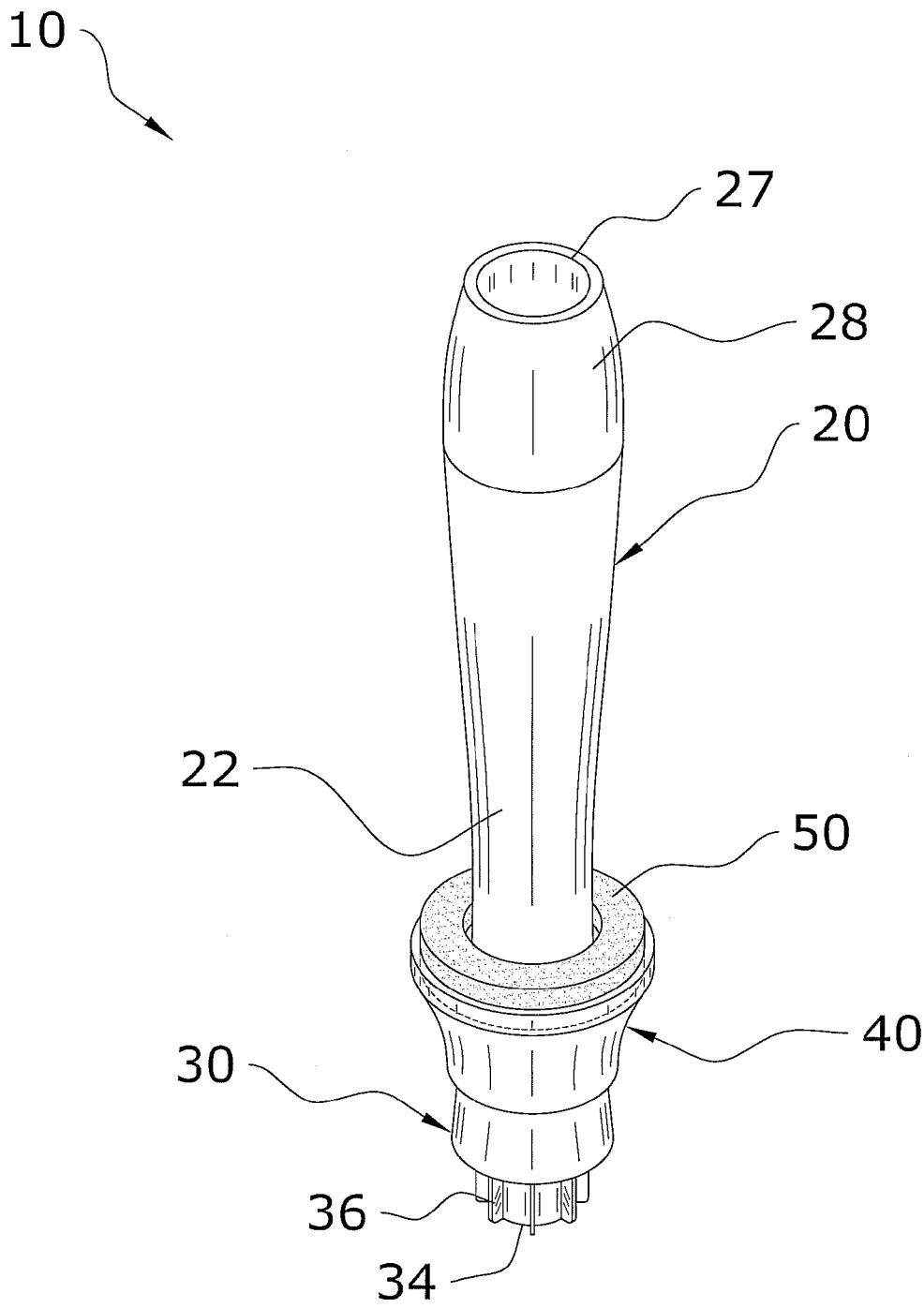
FIG. 1 is an upper perspective view of the present invention in a non-use position.

Turning now descriptively to the drawings, in which similar reference characters denote similar elements throughout the several views, FIGS. 1 through 7 illustrate a marker eraser system 10, which comprises a body having a tubular structure and a central aperture 42 extending through the tubular structure. The central aperture 42 extends through an inner end 49 to an outer end 43 of the body. An eraser member 50 is attached to the outer end 43 of the eraser unit 40 to erase a removable ink from a dry erase writing instrument 20. An outer end 43 of the central aperture 42 frictionally receives an outer portion of a first end 32 of a cap 30 of the dry erase writing instrument 20 to allow a user to removably attach the marker eraser system 10 to the cap 30 of the dry erase writing instrument 20.

B. Writing Instrument

The writing instrument 20 is preferably comprised of a conventional dry erase marker that dispenses a removable ink upon various surfaces such as but not limited to whiteboards. The writing instrument 20 includes a handle 22 as illustrated in FIGS. 1 through 4. The handle 22 is preferably comprised of a plastic material. However other materials may be utilized during construction of the handle 22.

The handle 22 is preferably comprised of an elongated configuration as shown in FIGS. 1 through 4. The handle 22 is also preferably comprised of an ergonomic configuration. Further, an outer shell of the handle 22 is preferably comprised of a rubber material so as to be easily and comfortably gripped by a user. It is also appreciated that the handle 22 may include various indicia and logos an outer shell of the handle 22.

The handle 22 preferably includes a receiving member 28 as shown in FIGS. 1 through 4. The receiving member 28 is preferably positioned on a receiving end of the handle 22 opposite the writing tip 24. The receiving member 28 preferably extends longitudinally outward from the handle 22. The receiving member 28 is preferably comprised of a plastic material. However other materials may be utilized during construction of the receiving member 28. It is appreciated that the receiving member 28 is preferably comprised of a separate structure than the handle 22; however the receiving member 28 may be comprised of an integrally formed structure with the handle 22.

Figure 2:
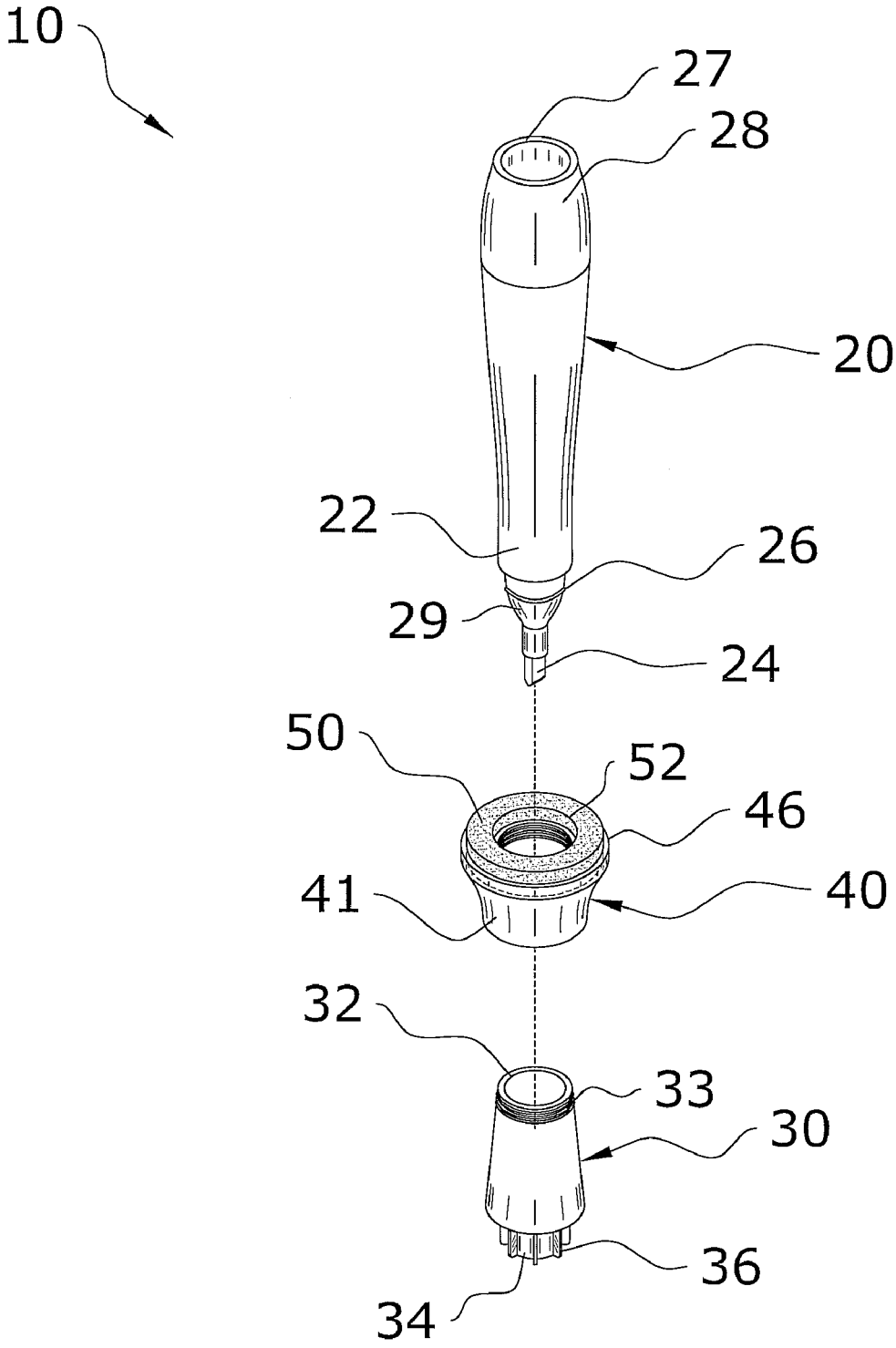
FIG. 2 is an exploded upper perspective view of the present invention.
Figure 3:
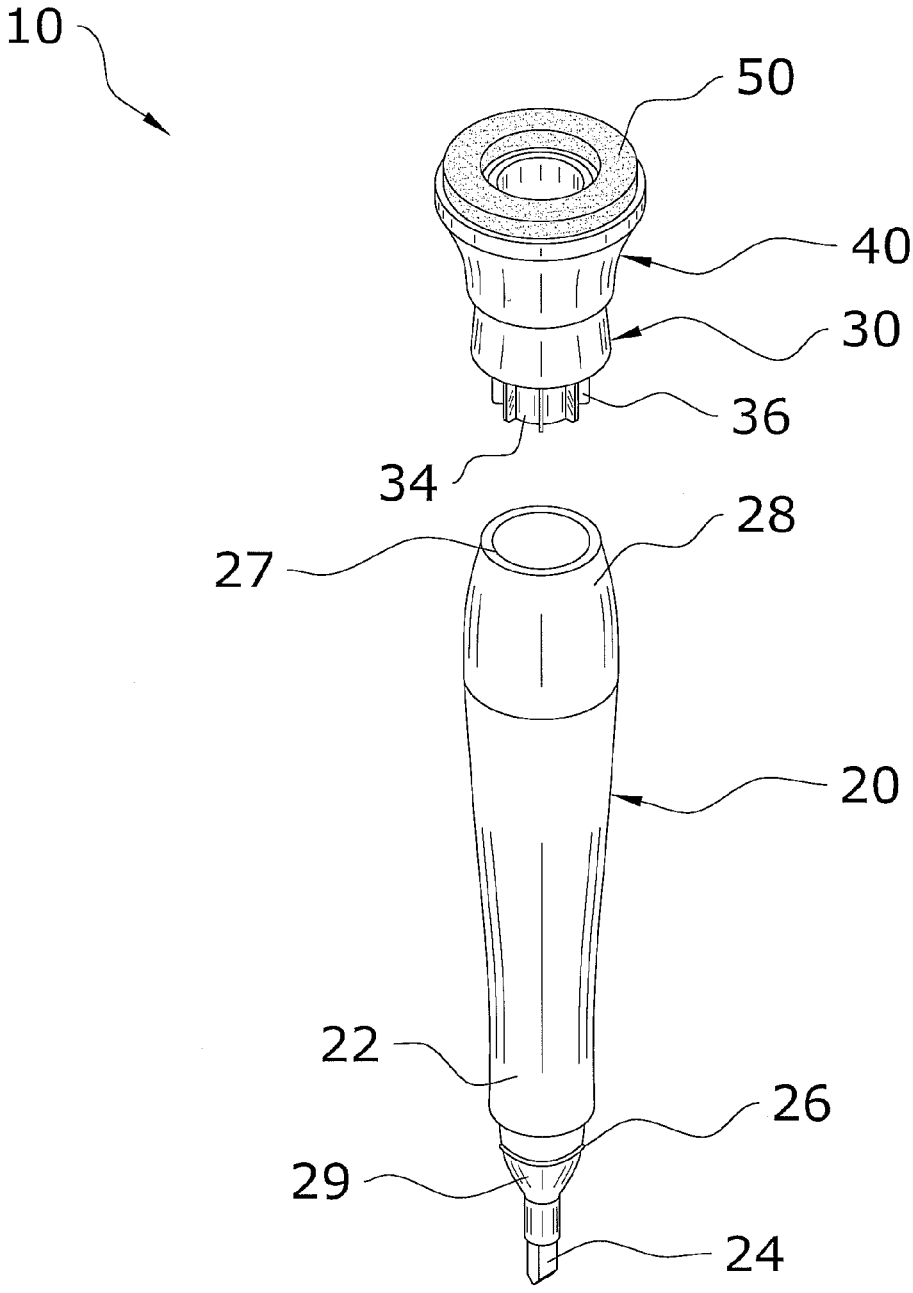
FIG. 3 is an upper perspective view of the present invention with the cap removed.
Figure 4:
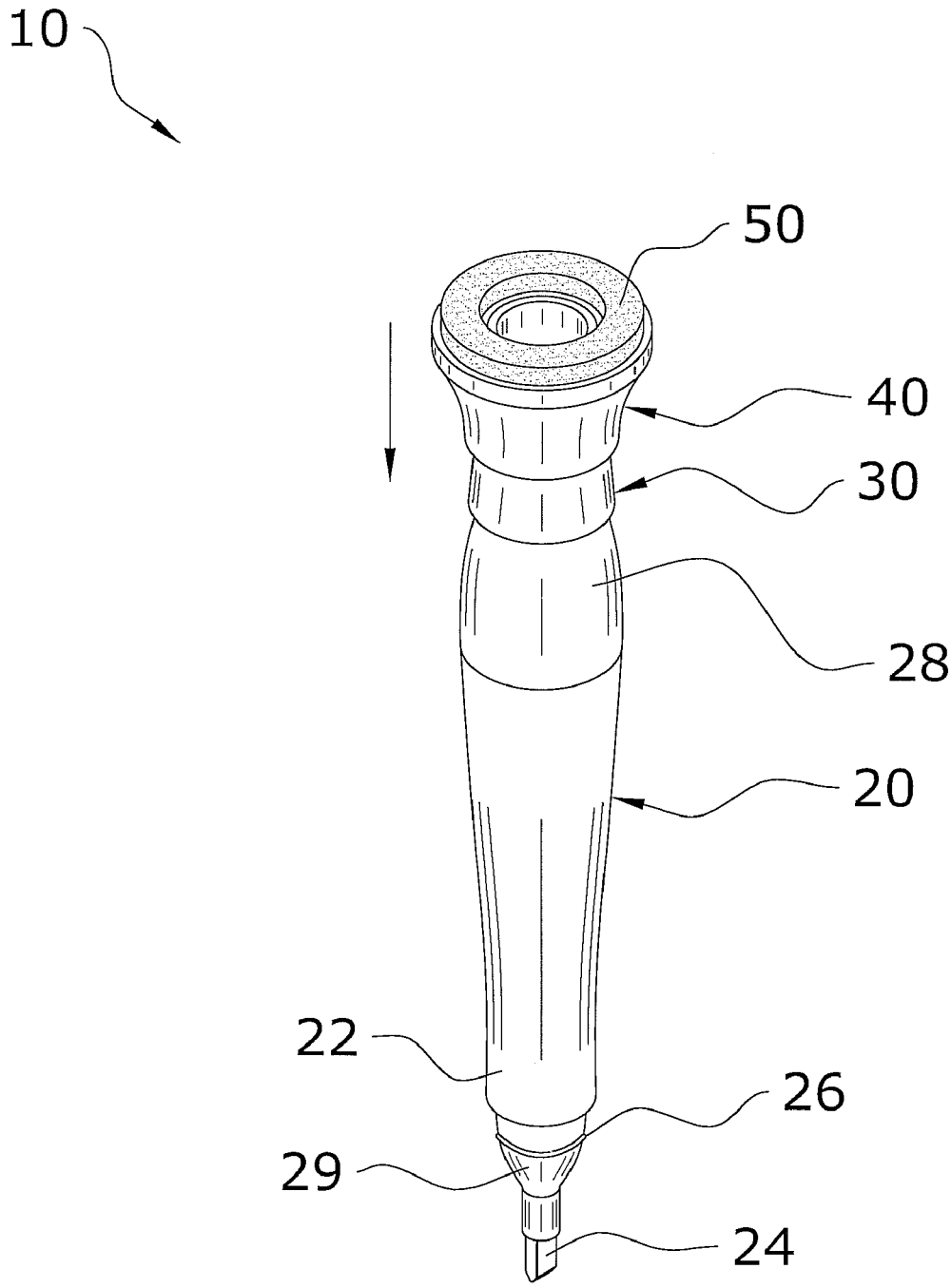
FIG. 4 is an upper perspective view of the present invention in use.

The receiving member 28 also preferably includes a receiver end 27 as shown in FIGS. 1 through 3. The receiver end 27 is preferably comprised of a cavity configuration, wherein the receiver end 27 extends into the receiving member 28 as shown in FIGS. 1 through 3. An opposing end of the handle 22 preferably includes a writing end 29 as shown in FIGS. 2 through 4. The writing end 29 preferably includes a writing tip 24 as shown in FIGS. 2 through 4. The writing tip 24 is preferably comprised of a dry erase marker writing tip 24, wherein the writing tip 24 dispenses a removable ink. The writing tip 24 may be comprised of various colors and shapes.

The writing end 29 also preferably includes an attachment member 26 as shown in FIGS. 2 through 4. The attachment member 26 is preferably comprised of a ring configuration. The attachment member 26 preferably extends outwardly from the writing end 29. It is appreciated that the attachment member 26 is preferably comprised of an integrally formed structure with the handle 22; however the attachment member 26 may be comprised of a separate structure than the handle 22. It is also appreciated that the attachment member 26 may be comprised of various structures other than the preferred embodiment.

A cap 30 removably attaches to the writing instrument 20 as shown in FIGS. 2 and 3. The cap 30 preferably covers the writing tip 24 of the writing instrument 20 to prevent drying out of the writing tip 24 and accidental writing from the writing tip 24 during non use of the writing instrument 20. The cap 30 is preferably comprised of a plastic material; however other materials may be utilized during construction of the cap 30. The cap 30 is also preferably comprised of an elongated circular configuration. The cap 30 preferably has a tapering structure as best illustrated in FIGS. 6 and 7 of the drawings.

Figure 5:
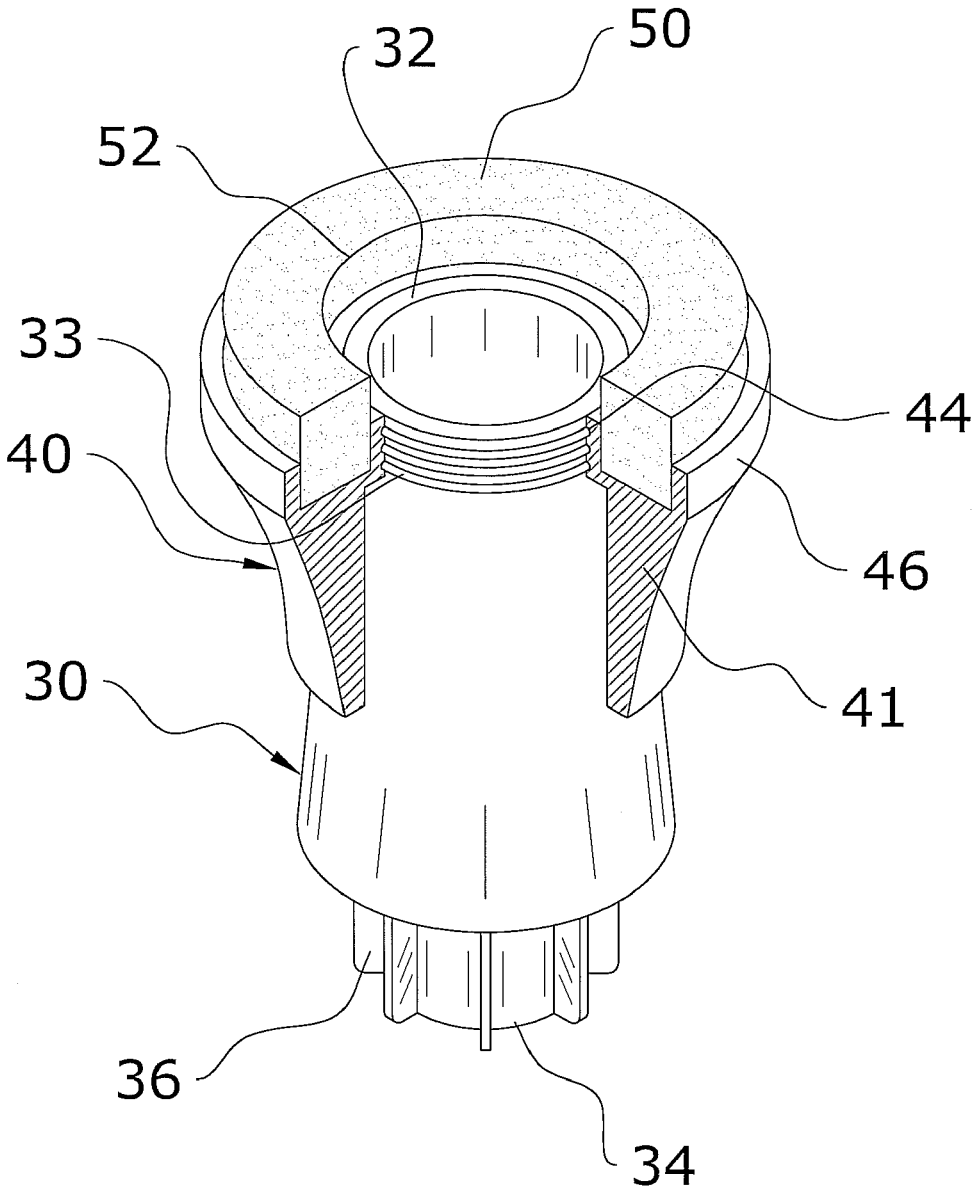
FIG. 5 is a sectional upper perspective view of the cap and attached eraser unit.
Figure 6:
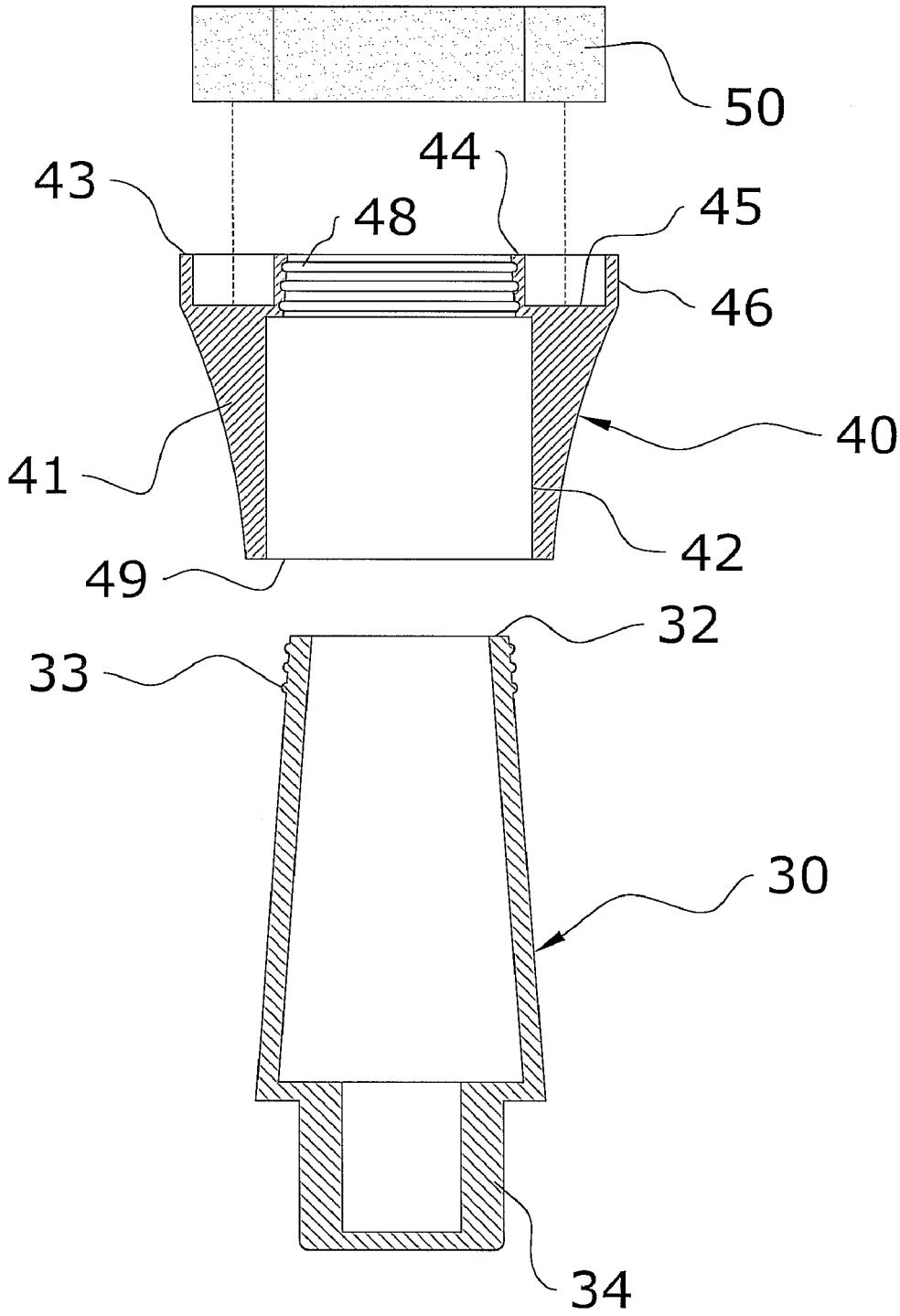
FIG. 6 is a side cross-sectional view of the eraser unit attaching to the cap.
Figure 7:
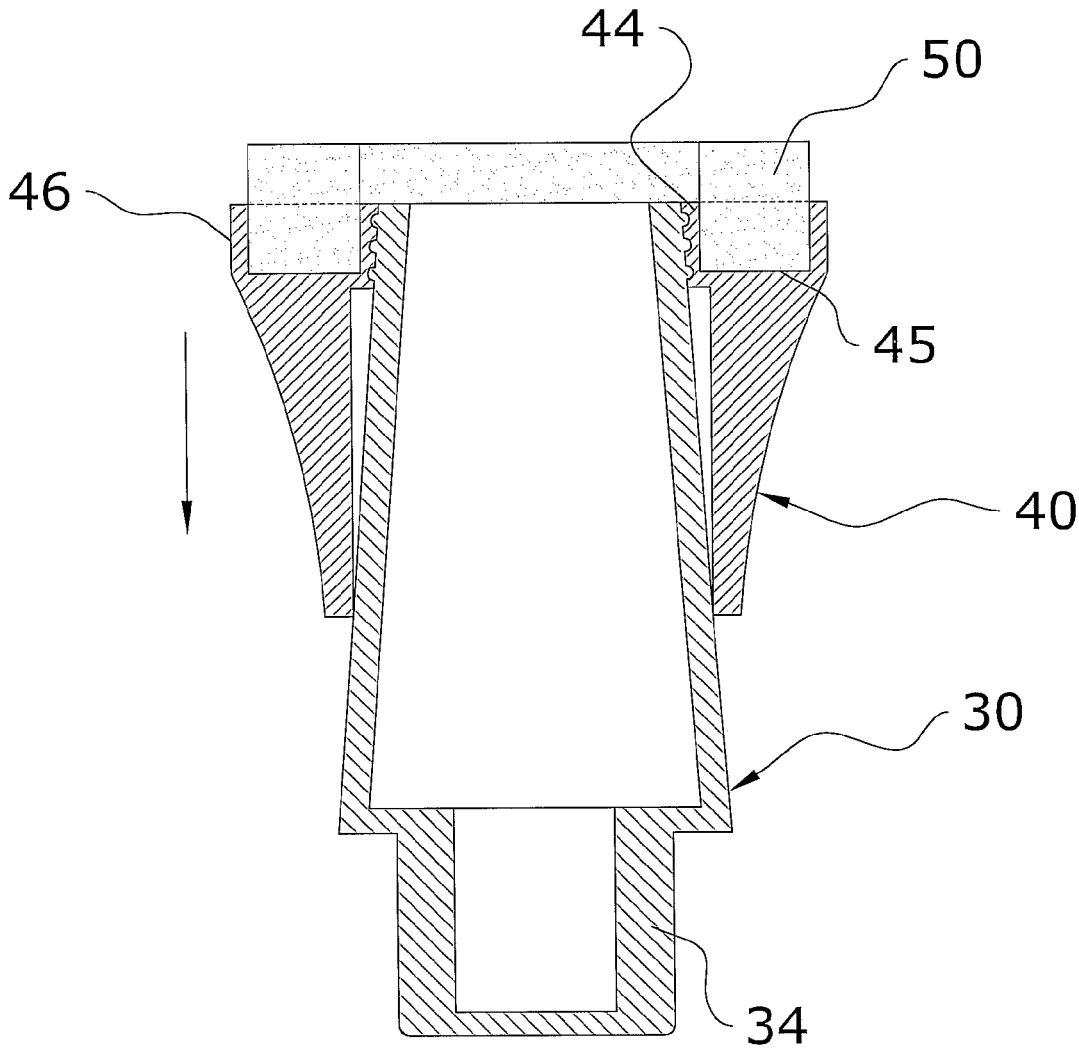
FIG. 7 is a side cross-sectional view of the eraser unit attached to the cap.

The cap 30 includes a first end 32, as shown in FIGS. 2, 5, and 6, and a second end 34 as illustrated in FIGS. 1 through 3 and 5 through 7. The first end 32 is preferably comprised of a cavity configuration and receives the writing tip 24 and writing end 29 of the writing instrument 20. The writing tip 24 is positioned within the second end 34 of the cap 30 when the cap 30 is removably attached to the writing end 29 of the writing instrument 20. An inner diameter of the first end 32 of the cap 30 is preferably substantially similar to an outer diameter of the writing end 29 of the handle 22. The first end 32 preferably attaches to the writing end 29 of the writing instrument 20 via the attachment member 26.

The first end 32 also preferably includes at least one raised member 33. Further, the first end 32 preferably includes a plurality of raised members 33. The raised members 33 are preferably comprised of a ring configuration and extend outwardly from an outer perimeter adjacent to the first end 32 as illustrated in FIGS. 2, 5, and 6. The raised members 33 are also preferably comprised of a cincture structure. The raised members 33 are further preferably parallel to one another. It is appreciated that the raised member 33 may be comprised of various configurations other than the preferred embodiment.

The second end 34 of the cap 30 is preferably positioned on an opposing end of the cap 30 as the first end 32. The second end 34 is preferably comprised of an elongated circular configuration. The second end 34 is also preferably comprised of a substantially hollow configuration. The second end 34 preferably includes a plurality of ridge members 36 as illustrated in FIGS. 1 through 3 and 5 through 7. The ridge members 36 are preferably equidistant around the second end 34. The ridge members 36 also preferably radiate outwardly as shown in FIGS. 1 through 3 and 5. The outer diameter of the second end 34 and ridge members 36 of the cap 30 is preferably substantially similar to an inner diameter of the receiver end 27 of the receiving member 28 of the writing instrument 20.

C. Eraser Unit

The eraser unit 40 is preferably comprised of a conventional dry eraser that removes a removable ink dispensed from a conventional dry erase marker upon various surfaces such as but not limited to whiteboards. The eraser unit 40 includes a body portion 41. The body portion 41 is preferably comprised of a plastic material, however it is appreciated that various materials may be utilized in the construction of the body portion 41. The body portion 41 is comprised of a tubular structure to receive the cap 30 as illustrated in FIGS. 5 through 7. An outer portion of the body portion 41 is preferably comprised of an outwardly tapering structure as shown in FIGS. 6 and 7.

The body portion 41 receives the cap 30 through a central aperture 42. The central aperture 42 extends through an inner end 49 to an opposing outer end 43 of the body portion 41. An inner perimeter of the central aperture 42 is preferably comprised of a consistent diameter as shown in FIGS. 6 and 7. An inner diameter of the inner end 49 is preferably substantially greater than an outer diameter of the first end 32 of the cap 30 as shown in FIG. 6. The inner diameter of the inner end 49 is further substantially similar to an outer diameter of the cap 30 substantially near the second end 34 as shown in FIG. 7. The inner end 49 of the central aperture 42 preferably frictionally receives the outer portion of the first end 32 of the cap 30. A partial cavity is preferably formed between the outer portion of the cap 30 and the central aperture 42 when the cap 30 is removably attached to the eraser unit 40 as shown in FIG. 7.

The outer end 43 preferably includes an inner rim 44 and a perimeter rim 46. The inner rim 44 and the perimeter rim 46 both preferably extend around the outer end 43 of the eraser unit 40 thus forming a circular structure. The inner rim 44 preferably extends inwardly from the central aperture 42 to engage the first end 32 of the cap 30. The inner rim 44 further preferably includes a plurality of ribs 48 extending inwardly around an inner diameter of the inner rim 44 as shown in FIGS. 5 through 7. The plurality of ribs 48 are preferably parallel to one another.

The plurality of ribs 48 further preferably frictionally engage the raised members 33 of the cap 30 when the first end 32 of the cap 30 is extended through the eraser unit 40. When the ribs 48 are removably attached to the raised members 33 the cap 30 is preferably prevented from extending further upward through the eraser unit 40 by the tapering structure of the cap 30 engaging the central aperture 42 and inner rim 44 of the eraser unit 40 as shown in FIG. 7.

A receiver channel 45 is preferably formed between the inner rim 44 and the perimeter rim 46 as shown in FIG. 6. The perimeter rim 46 preferably surrounds the receiver channel 45 and the inner rim 44 preferably surrounds the central aperture 42. A first configuration of the receiver channel 45 is preferably substantially similar to a second configuration of the eraser member 50, wherein the receiver channel 45 receives the eraser member 50. The receiver channel 45 is further preferably comprised of a circular configuration and the eraser member 50 is preferably comprised of a circular configuration.

The eraser member 50 removes a removable ink dispensed from a conventional writing tip 24 of a dry erase marker upon various surfaces such as but not limited to whiteboards. The eraser member 50 forms a ring structure when positioned within the receiver channel 45 as shown in FIGS. 1 through 5. The eraser member 50 includes an opening 52 along an inner side of the eraser member 50. An inner diameter of the opening 52 is preferably substantially similar to the inner diameter of the central aperture 42. The opening 52 is further preferably concentric with the central aperture 42. The opening 52 allows the eraser unit 40 and attached cap 30 to receive the writing end 29 of the writing instrument 20 when the marker eraser system 10 is not in use as shown in FIGS. 1 and 2. It is appreciated that the eraser unit 40 is preferably comprised of a separate structure than the cap 30; however the eraser unit 40 may be comprised of an integrally formed structure with the cap 30.

D. Operation of Invention

In use, the cap 30 and attached eraser unit 40 are removed from the writing end 29 of the writing instrument 20. The second end 34 of the cap 30 is then inserted into the receiving end 27 of the receiving member 28 of the writing instrument 20 as illustrated in FIGS. 3 and 4. The handle 22 of the writing instrument 20 may now be comfortably grasped and the writing tip 24 of the writing instrument 20 may be utilized.

If it is desired to erase the markings from the writing tip 24, the writing instrument 20 is turned around and the user may erase the markings with the attached eraser member 50. When the user is finished using the writing instrument 20, the cap 30 and attached eraser unit 40 are detached form the receiving member 28 of the writing instrument 20. The first end 32 of the cap 30 is then attached to the writing end 29 of the writing instrument 20 thus covering the writing tip 24. The eraser unit 40 may also be removed from the cap 30 and utilized with a different writing instrument 20 of a similar structure to the writing instrument 20 and cap 30 of the marker eraser system 10.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A marker eraser system, comprising:

a writing instrument including a cap, a writing end and a receiver end;

wherein said cap includes a first end and a second end, wherein said first end is removably connectable to said writing end to selectively cover a writing tip and wherein said second end is removably connectable to said receiver end;

an eraser unit comprising a body having a tubular structure and a central aperture, wherein said central aperture extends through an inner end to an outer end of said body, and wherein an outer end of said central aperture frictionally receives an outer portion of said first end of said cap;

wherein said eraser member includes an opening that corresponds to said central aperture; and an eraser member attached to said outer end of said eraser unit.

2. The marker eraser system of claim 1, wherein said eraser member is comprised of a ring structure having an opening.

3. The marker eraser system of claim 1, wherein said outer end includes a receiver channel and wherein said eraser member is attached within said receiver channel.

4. The marker eraser system of claim 3, wherein said outer end includes a perimeter rim that surrounds said receiver channel and an inner rim that surrounds said central aperture.

5. The marker eraser system of claim 1, wherein an inner wall of said eraser unit defining said central aperture includes a plurality of ribs adjacent said outer end.

6. The marker eraser system of claim 5, wherein said plurality of ribs are substantially parallel to one another.

7. The marker eraser system of claim 5, wherein said plurality of ribs frictionally and catchably engage a plurality of raised members, wherein said plurality of raised members extend outwardly from said cap adjacent said first end.

8. The marker eraser system of claim 7, wherein said plurality of raised members are comprised of a cincture structure.

9. The marker eraser system of claim 1, wherein an inner wall of said eraser unit defining said central aperture includes an engaging portion that extends inwardly and includes a plurality of ribs, wherein a rib portion of said plurality of ribs is adjacent said outer end.

10. The marker eraser system of claim 9, wherein said central aperture is comprised of a consistent diameter and wherein said engaging portion extends inwardly with respect to said central aperture.

11. The marker eraser system of claim 1, wherein an outer portion of said body is comprised of a tapering structure.

12. A marker eraser system, comprising:

a writing instrument including a cap, a writing end and a receiver end;

wherein said cap includes a first end and a second end, wherein said first end is removably connectable to said writing end to selectively cover a writing tip and wherein said second end is removably connectable to said receiver end;

an eraser unit comprising a body having a tubular structure and a central aperture, wherein said central aperture extends through an inner end to an outer end of said body, and wherein an inner end of said central aperture frictionally receives an outer portion of said first end of said cap;

wherein said central aperture is comprised of a consistent diameter and wherein an engaging portion of said outer end extends inwardly with respect to said central aperture; and an eraser member attached to said outer end of said eraser unit, wherein said eraser member is comprised of a ring structure having an opening that corresponds to said central aperture, wherein said opening is similar in shape and size to said central aperture;

wherein said outer end includes a receiver channel and wherein said eraser member is attached within said receiver channel.

13. The marker eraser system of claim 12, wherein said outer end includes a perimeter rim that surrounds said receiver channel and an inner rim that surrounds said central aperture.

14. The marker eraser system of claim 12, wherein an inner wall of said eraser unit defining said central aperture includes a plurality of ribs adjacent said outer end.

15. The marker eraser system of claim 14, wherein said plurality of ribs are substantially parallel to one another.

16. The marker eraser system of claim 14, wherein said plurality of ribs frictionally and catchably engage a plurality of raised members, wherein said plurality of raised members extend outwardly from said cap adjacent said first end.

17. The marker eraser system of claim 16, wherein said plurality of raised members are comprised of a cincture structure.

18. The marker eraser system of claim 12, wherein an inner wall of said eraser unit defining said central aperture includes an engaging portion that extends inwardly and includes a plurality of ribs, wherein a rib portion of said plurality of ribs is adjacent said outer end.

19. An eraser system for a dry erase marker, comprising:

an eraser unit comprising a body having a tubular structure and a central aperture, wherein said central aperture extends through an inner end to an outer end of said body, and wherein an inner end of said central aperture frictionally receives an outer portion of a first end of a cap;

wherein said central aperture is comprised of a consistent diameter and wherein an engaging portion extends inwardly with respect to said central aperture; and an eraser member attached to said outer end of said eraser unit, wherein said eraser member is comprised of a ring structure having an opening that corresponds to said central aperture, wherein said opening is similar in shape and size to said central aperture;

wherein said outer end includes a receiver channel and wherein said eraser member is attached within said receiver channel;

wherein said outer end includes a perimeter rim that surrounds said receiver channel and an inner rim that surrounds said central aperture;

wherein an inner wall of said eraser unit defining said central aperture includes a plurality of ribs adjacent said outer end, wherein said plurality of ribs form an engaging portion that extends inwardly with respect to said central aperture;

wherein said plurality of ribs frictionally and catchably engage a plurality of raised members, wherein said plurality of raised members extend outwardly from said cap adjacent said first end;

wherein said plurality of raised members are comprised of a cincture structure;

wherein said plurality of ribs are substantially parallel to one another.

20. A marker eraser system, comprising:

a writing instrument including a cap, a writing end and a receiver end;

wherein said cap includes a first end and a second end, wherein said first end is removably connectable to said writing end to selectively cover a writing tip and wherein said second end is removably connectable to said receiver end;

an eraser unit comprising a body having a tubular structure and a central aperture, wherein said central aperture extends through an inner end to an outer end of said body, and wherein an outer end of said central aperture frictionally receives an outer portion of said first end of said cap; and an eraser member attached to said outer end of said eraser unit, wherein said eraser member is comprised of a ring structure having an opening.

21. A marker eraser system, comprising:

a writing instrument including a cap, a writing end and a receiver end;

wherein said cap includes a first end and a second end, wherein said first end is removably connectable to said writing end to selectively cover a writing tip and wherein said second end is removably connectable to said receiver end;

an eraser unit comprising a body having a tubular structure and a central aperture, wherein said central aperture extends through an inner end to an outer end of said body, and wherein said central aperture frictionally receives an outer portion of said first end of said cap;

wherein said eraser member includes an opening that corresponds to said central aperture; and an eraser member attached to said outer end of said eraser unit.

22. A marker eraser system, comprising:

a writing instrument including a cap, a writing end and a receiver end;

wherein said cap includes a first end and a second end, wherein said first end is removably connectable to said writing end to selectively cover a writing tip and wherein said second end is removably connectable to said receiver end;

an eraser unit comprising a body having a tubular structure and a central aperture, wherein said central aperture extends through an inner end to an outer end of said body, and wherein said central aperture frictionally receives an outer portion of said first end of said cap; and an eraser member attached to said outer end of said eraser unit;

wherein said outer end includes a receiver channel and wherein said eraser member is attached within said receiver channel;

wherein said outer end includes a perimeter rim that surrounds said receiver channel and an inner rim that surrounds said central aperture.

* * * * *